United States Patent [19]

Juker

[11] 4,395,855

[45] Aug. 2, 1983

[54] KNOCK DOWN EXPANDABLE REVERSIBLE DOOR FRAME

[75] Inventor: Gerald F. Juker, Maple Ridge, Canada

[73] Assignee: Windor Sales Limited, Port Coquitlam, Canada

[21] Appl. No.: 229,955

[22] Filed: Jan. 30, 1981

[30] Foreign Application Priority Data

Apr. 3, 1980 [CA] Canada ..... 349266

[51] Int. Cl.[3] ..... E06B 1/20

[52] U.S. Cl. ..... 52/212; 49/505

[58] Field of Search ..... 52/211, 212, 217, 656; 49/505, 504; 312/350

[56] References Cited

U.S. PATENT DOCUMENTS

| | | | |
|---|---|---|---|
| 2,651,814 | 9/1953 | Lester | 49/505 |
| 3,420,003 | 1/1969 | Cline | 52/212 |
| 3,429,076 | 2/1969 | Fortsch | 52/211 |
| 3,808,759 | 5/1974 | Carmichael | 52/212 |
| 3,906,671 | 9/1975 | Maldonado | 49/505 |
| 4,012,868 | 3/1977 | Andruszkiewicz | 49/505 |
| 4,014,146 | 3/1977 | Mascio | 52/211 |
| 4,067,632 | 1/1978 | Sekerich | 312/350 |

FOREIGN PATENT DOCUMENTS

| | | |
|---|---|---|
| 983321 | 2/1976 | Canada . |
| 1020810 | 11/1977 | Canada . |
| 1032018 | 5/1978 | Canada . |

*Primary Examiner*—Reinaldo P. Machado

*Attorney, Agent, or Firm*—Knobbe, Martens, Olson & Bear

[57] ABSTRACT

This invention is directed to a novel door frame assembly. More particularly, this invention is directed to a pre-fabricated door frame assembly, the components of which are adjustable and such that the assembly can be used for either right hand or left hand doors and can fit a wide variety of widths and heights of door openings through walls of various thicknesses. The invention includes a slide guide unit, two of which in interlocking combination are suitable for use in constructing an adjustable width jamb as part of a pre-fabricated door frame assembly, comprising:

(a) a generally broad body having therein along one side thereof a V-shaped groove extending substantially the length of the body;

(b) a first V-profile tab located at the same side of the body as the V-shaped groove, extending from the body in a direction away from the V-shaped groove, and in a plane generally aligned with the plane of the body and the V-shaped groove, the dimension of the V of the first V-shaped tab being generally commensurate with the dimension of the interior of the V-shaped groove; and (c) a second V-profile tab positioned on the same side of the body as the first V-profile tab, and in general alignment with the first V-profile tab extending in generally the same direction as the first V-profile tab, the dimension of the V of the second V-profile tab being generally commensurate with the dimension of the exterior of the V-shaped groove.

11 Claims, 12 Drawing Figures

KNOCK DOWN EXPANDABLE REVERSIBLE DOOR FRAME

FIELD OF THE INVENTION

This invention is directed to a novel door frame assembly. More particularly, this invention is directed to a pre-fabricated door frame assembly, the components of which in assembled form fit either right hand or left hand doors and are adjustable so that the assembly can fit a wide variety of widths and heights of door openings through walls of various thicknesses.

BACKGROUND OF THE INVENTION

At one time, in the construction of commercial and residential buildings and the like, the frames around doors were custom made and erected by carpenters, and the like, and the erected door frames were then hand painted by professional painters. This method of construction was labour intensive and hence costly.

More recently, to reduce labour content, pre-fabricated pre-finished door frame assemblies have become popular. Such frame assemblies, while having the advantages of being pre-finished with one or more of an assortment of finishes such as woodgrain or paint surfaces, and being readily erectable, nevertheless suffer from certain deficiencies. One deficiency is that the width of the door jamb is fixed, and hence the pre-fabricated door frame only fits a wall of a given thickness. Consequently, if there is much variation in wall thickness in comparison with the dimensions of the door frame, the door frame is not satisfactory, and another door frame assembly of the required jamb width is required. Right hand and left hand doors also create difficulties. Accordingly, rejections at the construction site frequency occur and replacement door frame assemblies must be supplied, thereby increasing costs of construction.

Relatively recently, several Canadian patents have been granted for door frame assemblies which have hinge, strike, and header jambs, that can be varied in width to accommodate different thicknesses of walls. Canadian Pat. Nos. 983,321, issued Feb. 10, 1976, 1,020,810, issued Nov. 15, 1977 and 1,032,018, issued May 30, 1978, each granted to Eldon W. Carmichael, disclose several types of door frame assemblies which can accommodate different wall thicknesses. However, the door frame assemblies disclosed and claimed in these patents incorporate a number of features which appear to detract from the utility of the door frame assemblies in certain construction situations. The Carmichael door frame assemblies as part of the variable width jamb feature, utilize a slide guide which is constructed with springs or with a tongue and groove arrangement, both of which constructions are relatively expensive and hence unsuitable for certain construction jobs.

Once a variable jamb width door frame assembly is in place in the opening through a wall, the width of the jamb is fixed and need not be adjusted further. Accordingly, a slide guide equipped with a spring is of marginal benefit. While the presence in the slide guide of a spring under tension tends to hold the side moldings of the door frame snug against both sides of the wall, such springs are apparently not absolutely necessary in order to provide an attractive appearance to the erected door frame. Similarly, a tapered tongue and groove slide guide assembly, while being of some utility in holding the components of the door jambs in planar alignment, is not of much assistance in holding the components in vertical alignment (when one considers the erected frame assembly) because the tapered tongue and groove construction, by reason of its design, particularly when it is in extended orientation, permits a certain amount of "play" to occur in the slide guide. Hence, one jamb component can be moved upwardly or downwardly in relation to the other jamb component. Furthermore, the Carmichael door frame assemblies, by design, utilize mitred frame corners, which tend to be costly to produce, and which are somewhat disadvantageous in certain construction situations because a perfectly square corner must be formed in order for the mitred joints to fit closely and give the assemblied door frame a good appearance.

SUMMARY OF THE INVENTION

The subject invention is directed to a pre-fabricated door frame assembly which is of a relatively low cost, simple to install, constructed of simple and reliably operating components, and capable of fitting a wide variety of widths of door openings, and wall thicknesses. The door frame assembly of the invention can be constructed of wood, steel, or other suitable construction materials. The door frame assembly can accommodate customary single or double doors. The door frame assembly of the invention can fit eight right hand or left hand doors, and no special cutting must be done to adapt the door frame assembly to either right hand or left hand doors.

The steel door frame assembly passes the Warnock-Hersey 1½ Fire Test.

The pre-fabricated door frame assembly of the invention consists of an adjustable width hinge jamb, an adjustable width strike jamb, an adjustable width header jamb, casing (molding) and a standard size door. The assembly is reversible and can accomodate either right hand or left hand doors.

The pre-fabricated door frame assembly of the invention is shipped to purchasers, contractors, or the construction site in knock-down components. A carpenter at the construction site can quickly install the door frame assembly in a wall opening having a variable wall thickness by first measuring the wall opening for proper width, and then fastening an adjustable width header jamb into place at the top of the door opening by using nails and clips which are provided as part of the door frame assembly. Next, the adjustable width hinge jamb is fastened in place by means of nails and clips provided as part of the assembly so that the top of the hinge jamb meets and abuts at right angles with the installed header jamb. Hinges are provided with the hinge jamb. A pre-fabricated standard size door is then hung in place by means of the door hinges. Once the door has been hung, the free floating strike door jamb is fastened in place on the opposite side of the door opening by means of supplied nails and clips so that the strike frame is properly congruent with the door swinging on its hinges. When everything has been properly fitted, the door frame is permanently fastened to the door opening by hammering further nails through the clips provided in the three jamb pieces so that the door frame assembly and the door hung on the hinge jamb are permanently secured in place. Finally, door casing (molding) with 45° mitred corners is nailed in place around the periphery of the door jamb on both sides of the wall to conceal the clips and the nails in the clips, and provide an attractive border around the door frame. The door frame assembly can be either of wood or steel construction.

The invention is directed to a slide guide unit, suitable for use in constructing a jamb as part of a pre-fabricated door frame assembly, comprising:

(a) a generally broad body having therein along one side thereof a V-shaped groove extending substantially the length of the body;

(b) a first V-profile tab located at the same side of the body as the V-shaped groove, extending from the body in a direction away from the V-shaped groove, and in a plane generally aligned with the plane of the body and the V-shaped groove, the dimension of the V of the first V-shaped tab being generally commensurate with the dimension of the interior of the V-shaped groove; and (c) a second V-profile tab positioned on the same side of the body as the first V-profile tab, and in general alignment with the first V-profile tab extending in generally the same direction as the first V-profile tab, the dimension of the V of the second V-profile tab being generally commensurate with the dimension of the exterior of the V-shaped groove.

A slide guide according to the invention wherein the first and second V-profile tabs are adjacent one another on one side of the body, and the first V-profile tab is adapted to fit inside the V-shaped groove of a second slide guide unit, while the second V-profile tab is adapted to fit outside the V-shaped groove of the same second slide guide unit.

A slide guide according to the invention wherein a shoulder of the same general dimension as one side of the V-shaped groove is located on and extends from the side of the body opposite the V-shaped groove, and in the same general direction as the V-shaped groove.

A slide guide according to the invention wherein a projection is located at one end of the body and extends generally at right angles with the general plane of the body.

A slide guide according to the invention wherein a projection is located at one end of the body and extends generally at right angles with the general plane of the body while the base of the V-shaped groove extnds from the body in a direction generally opposite to the projection.

A slide guide according to the invention wherein a projection is located at one end of the body and extends generally at right angles with the general plane of the body while the base of the V-shaped groove extends from the body in a direction generally opposite to the projection, and the first and second V-profile tabs are located adjacent one another on the same side of the body as the V-shaped groove at the end of the body opposite the projection.

A door jamb assembly comprising:

(a) a first elongated jamb piece;

(b) a second elongated jamb piece adjacent the first jamb piece (a) and aligned generally parallel therewith; and (c) an elongated door stop secured to and aligned parallel with jamb piece (a) and concealing the joint between jamb pieces (a) and (b); and (c) a slide guide unit according to the invention affixed to jamb piece (a) on the side of jamb piece (a) opposite door stop (c), and a second slide guide unit according to the invention affixed to jamb piece (b) on the side of jamb piece (b) opposite door stop (c); said second slide guide unit being inverted in relation to the first slide guide unit so that the first and second V-profile tab of the first slide guide unit cooperate with the V-shaped groove of the inverted second slide unit so that the two slide guide units can be moved in relation to one another by sliding the first and second V-profile tabs along the V-shaped groove.

A door jamb assembly according to the invention wherein the slide guide means (d) consists of two cooperating slide guide units constructed according to the invention, so as to provide a means whereby jamb piece (a) of the invention can be spread apart from jamb piece (b) of the invention.

A door jamb assembly according to the invention wherein clips are located at each end of the two components of the assembled slide guide and extend away from the slide guide and jamb pieces (a) and (b).

A door jamb assembly according to the invention wherein three separate assemblies are utilized to frame a door opening, one door jamb assembly comprising a vertical hinge jamb unit, a second door jamb assembly comprising a vertical strike jamb unit, and a third door jamb assembly acting as a horizontal header jamb unit, the header jamb unit adjoining and bridging the respective top ends of the hinge jamb assembly and the strike jamb assembly.

A door jamb assembly according to the invention wherein three separate assemblies are utilized to frame a door opening, one door jamb assembly comprising a vertical hinge jamb unit, a second door jamb assembly comprising a vertical strike jamb unit, and a third door jamb assembly acting as a horizontal header jamb unit, the header jamb unit being equipped with slide guide units at each end, the ends of which units have downwardly extending clips which cooperate with and secure the two ends of the header jamb unit to the upper ends of the hinge jamb unit and the strike jamb unit respectively.

DRAWINGS

DETAILED DESCRIPTION OF AN EMBODIMENT OF THE INVENTION

Figure 1:
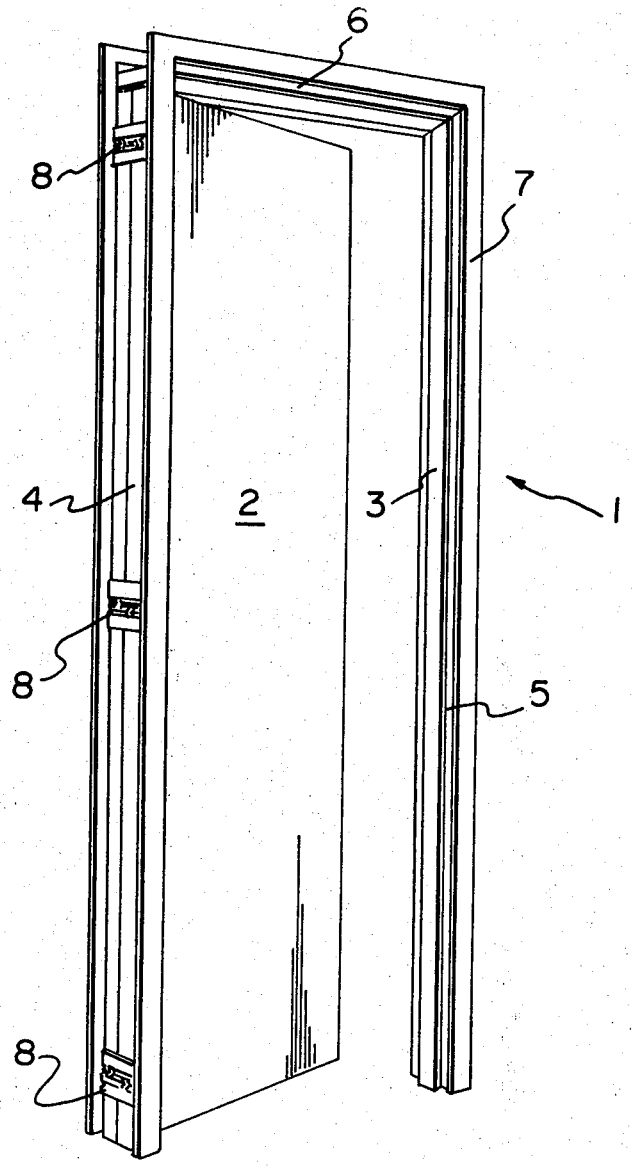
FIG. 1 illustrates a perspective view of the door frame assembly of the invention with a door hung on the hinge jamb.

As can be seen in FIG. 1, the door frame assembly 1 consists of an adjustable width hinge jamb 4 (shown on the left) adjoining at its top an adjustable width overhead header jamb 6, which in turn joins with and abuts an adjustable width strike jamb 5. A door casing 7 is fastened at the front face of the hinge jamb 4, the strike jamb 5, and the header jamb 6. The rear face of the hinge jamb 4 has fastened thereto on its rear face at three height locations three slide guides 8. A suitable number of slide guides 8 are also fastened to the concealed faces of the header jamb 6 and the strike jamb 5, but they are concealed from view in FIG. 1. The slide guides 8 permit the width of the hinge jamb 4 to be varied to accommodate different wall thicknesses. A door 2 is shown hung in place on the hinge jamb 4. The door frame assembly and door shown in FIG. 1 is constructed basically of wood, except for the slide guides 8.

Figure 2:
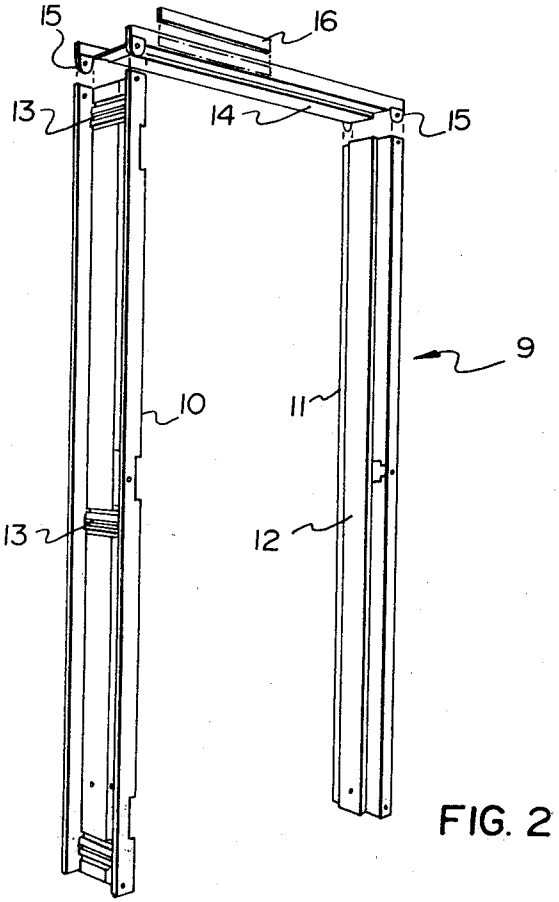
FIG. 2 illustrates a perspective view of a steel door frame assembly.

FIG. 2 illustrates a steel door frame assembly according to the invention. The steel door frame 9, is constructed of an adjustable width steel hinge jamb 10, an adjustable width steel strike jamb 11, a steel door stop 12, and an adjustable width steel header jamb 14. Located on the rear or concealed face of the steel hinge jamb 10, at three locations along its height, are three steel slide guides 13. Similar slide guides are located on the rear concealed faces of strike jamb 11 and header jamb 14.

Figure 3:
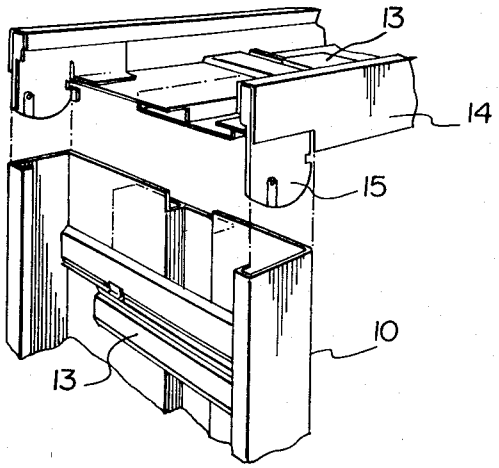
FIG. 3 illustrates a detailed enlarged perspective view of the top left corner of the steel door frame assembly perspectively illustrated in FIG. 2.

Corner gussets 15 are located at each end of the steel header jamb 14, and, as illustrated clearly in FIG. 3, the corner gusset 15 cooperates with and fits snugly with the sides of the steel hinge jamb 10. An optional reinforcing plate 16 can be included in the steel door frame assembly for automatic door closure reinforcing.

Figure 4:
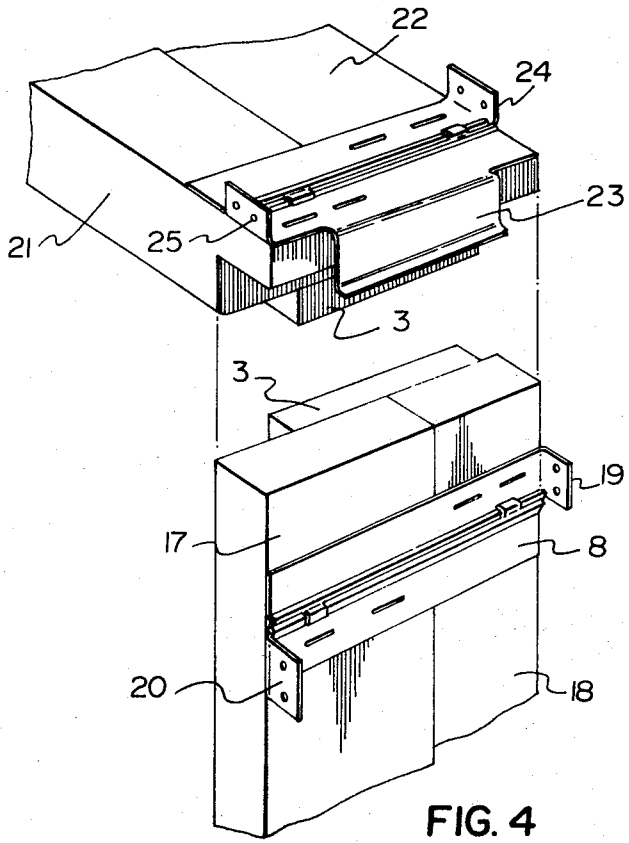
FIG. 4 illustrates a perspective corner detail of a door frame assembly of the invention constructed of wood.

Referring to FIG. 4, which illustrates a detailed perspective view of the corner assembly for wood door frame assembly, it can be seen that the hinge jamb 18 (or strike jamb if applicable) is constructed of three separate components. A first hinge jamb piece 17 abuts with and is aligned with a second hinge jamb piece 18. A door stop 3 abuts with and covers the meeting point for these two jamb pieces 17 and 18. Door stop 3 is fastened to either jamb piece 17 or jamb piece 18, but not both. Jamb pieces 17 and 18, and door stop 3, are held in place by a slide guide 8 which extends across the in situ concealed side of the two jamb pieces 17 and 18. Slide guide 8 is normally formed from a suitable construction metal and is assembled from two components (upper and lower components as shown in FIG. 4). At one end of the upper component is located a first slide guide clip 19. A second slide guide clip 20 is located at the opposite end of the lower component. Clips 19 and 20 are used for purposes of securing the entire jamb assembly to the wall alongside a door opening by means of nails, screws, or some other suitable fastening device.

FIG. 4 also illustrates a header jamb constructed of a first header jamb piece 21, a second header jamb piece 22 in planar alignment with first header jamb piece 21, the line of division between the two jamb pieces 21 and 22 being concealed by a door stop 3, when the header jamb assembly is installed in place. As with jamb pieces 17 and 18 of the hinge jamb assembly described above, door stop 3 is secured to one or the other of header jamb pieces 21 and 22, but not both. Header jamb pieces 21 and 22 are joined together by means of a header slide guide end clip 23. This end clip 23 is constructed from two components, the component with the end clip 23 having at one end thereof a header slide guide clip 25. The other component has a header slide guide clip 24 at the opposite end from clip 25. These clips 24 and 25 function in the same manner as clips 19 and 20 of slide guide 8 of the hinge jamb assembly and are used to secure the header jamb assembly to the top of a door opening by means of suitable fastening devices such a nails or screws.

FIG. 4 also illustrates how the ends of the two header jamb pieces 21 and 22 and the end of door stop 3 of the header jamb assembly are milled so that they fit snugly and readily with the top end of jamb pieces 17 and 18 and door stop 3 of the hinge jamb assembly. When joined together, the header jamb and the side jamb are held together snugly by end clip 23.

Figure 5:
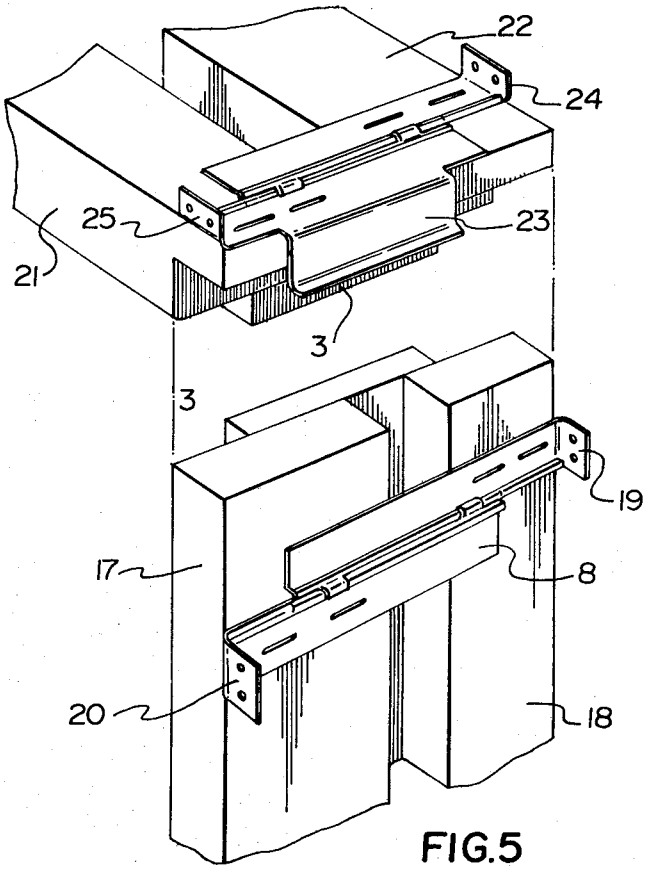
FIG. 5 illustrates a perspective view of the wood door frame assembly illustrated in FIG. 4, with the width of the respective side jamb and header jamb in extended orientation.

FIG. 5 illustrates a perspective view of the same corner construction illustrated in FIG. 4, except that the first and second hinge jamb pieces 17 and 18 are in extended planar orientation. Similarly, header jamb pieces 21 and 22 are also in extended planar orientation. The jamb pieces are held in place in their extended planar orientation by means of respective slide guide 8 and end clip slide guide 23 because the components of the respective slide guides 8 and 23 can be extended as shown in FIG. 5. It should be noted that even when jamb pieces 17 and 18, and header jamb pieces 21 and 22 are in extended orientation, respective door stop pieces 3 conceal the opening between the respective jamb pieces when the assembled door frame is installed in place. In other words, when the three door jambs are assembled in place around the periphery of a door opening in a wall, the openings between the respective jamb pieces cannot be seen because they are well concealed by the respective door stop pieces 3 on each jamb assembly. Furthermore, the extended slide guides cannot be seen because they are located on the concealed side of the respective jamb pieces. The clips 19 and 20, on the hinge jamb slide guide 8 and the clips 24 and 25 on the header jamb slide guide 23, as explained above, are used to secure the side jambs and the header jambs to the walls around the door opening. It can also be seen from examining FIG. 5 that the overall width of the jamb assemblies can be readily adjusted between a reasonably large range of dimensions to accomodate a wide range of wall thicknesses in a door opening.

Figure 6:
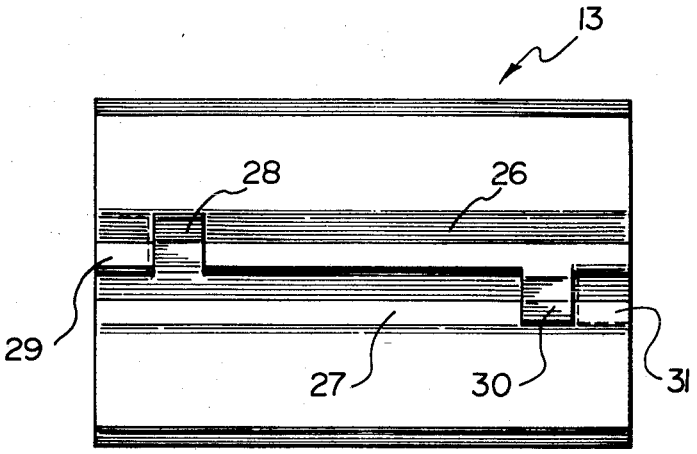
FIG. 6 illustrates a front elevation view of a slide guide for a steel door frame assembly.

FIG. 6 illustrates in detail the construction of a slide guide 13 that is suitable for use with a steel jamb assembly. The steel slide guide 13 used for steel jambs does not have end clips 19 or 20, or 24 or 25, as with the wood door jamb assemblies. Such clips are not necessary with the steel jamb assembly because the construction of the steel jamb assembly which in effect includes a casing (molding) with the jamb assembly. In the wood jamb door frame assembly, after erection, separate wood casings are installed to conceal slide guide clips 19 and 20, 24 and 25, and similar clips used on other jambs making up the door frame assembly.

Figure 8:
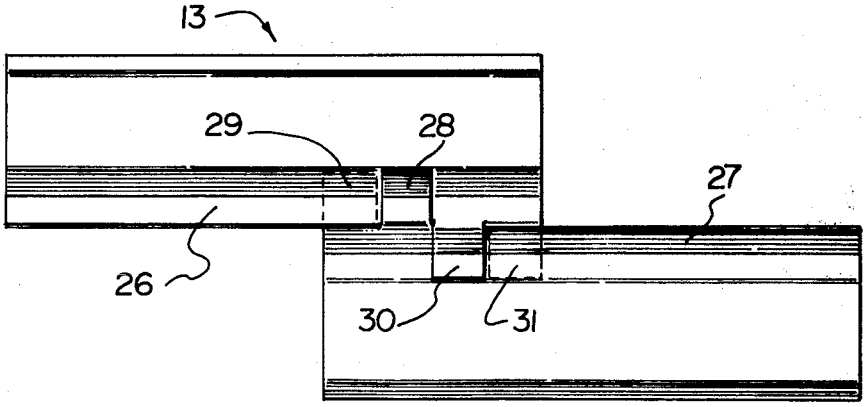
FIG. 8 illustrates a front elevation view of the steel slide guide of FIG. 6, with the two components of the slide guide in extended orientation.

Steel slide guide 13, as illustrated in FIG. 6, is constructed of two main components which are identical to one another and by inverting one interlock and cooperate with one another so that the upper and lower components can be slid sideways in relation to each other to assume various intermediate orientations until the fully extended orientation shown in FIG. 8 is reached.

Figure 7:
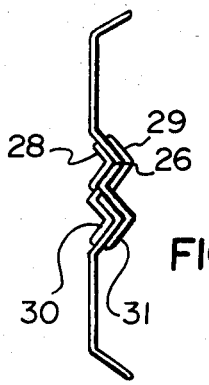
FIG. 7 illustrates an end elevation view of the steel slide guide illustrated in FIG. 6.

FIG. 7 illustrates an end elevation view of the steel slide guide 13 illustrated in FIG. 6. FIG. 7 illustrates in detail how the upper and lower components of the slide guide 13 interlock and cooperate with one another to provide a secure, strong, readily extendible device for guiding and holding the jamb components in a predetermined range of relative orientations to one another. The upper component of steel slide guide 13, as seen in FIG. 7, has formed therein at its lower edge a horizontal V-shaped groove 26. At the right end of the upper component of the steel slide guide 13, as seen in FIG. 6, there extends downwardly therefrom a V-profile tab 30. A similar V-profile underlying tab 31 is located to the right of tab 30, and, as shown in FIG. 6, is concealed from frontal view behind the V-shaped groove of the lower component of steel slide guide 13.

Identical to the upper component, but inverted, the lower component of steel slide guide 13 is constructed to have a horizontal V-shaped groove 27 along its upper edge. A V-profile tab 28 extends upwardly from the lower component of the steel slide guide 13. A second upwardly extending V-profile underlying tab 29 is located to the left of tab 28 and extends behind the V-shaped groove 26 of the upper component of the steel slide guide 13. The manner in which the respective tabs 28 and 30 and underlying tabs 29 and 31, cooperate with respective V-shaped grooves 26 and 27 is illustrated clearly in FIG. 7.

A major advantage of the steel slide guide construction 13 is that it has been designed so that the upper and lower components are identical with one another and hence each component can be formed from the same die. The upper component is merely an inverted version of the lower component. This is a major advantage because being able to form both components utilizing one die eliminates the necessity and expense of having separate dies form the upper and lower components of the slide guide, as is the case with various slide guide constructions shown in the prior art.

Figure 9:
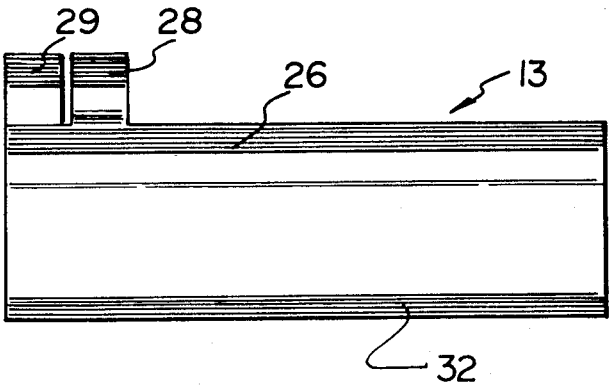
FIG. 9 illustrates a front elevation view of one component of the steel slide guide illustrated in FIG. 6.
Figure 10:
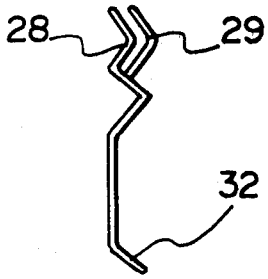
FIG. 10 illustrates an end elevation view of the steel slide guide component of FIG. 9.

FIG. 9 illustrates in detail the construction of the lower component of the steel slide guide 13, shown in FIGS. 6, 7 and 8. Each component is constructed to include a horizontal V-shaped groove 26, a V-profile tab 28, an upwardly extending V-profile underlying tab 29, and a shoulder 32, located at the lower edge opposite the V-profile groove 26.

Figure 11:
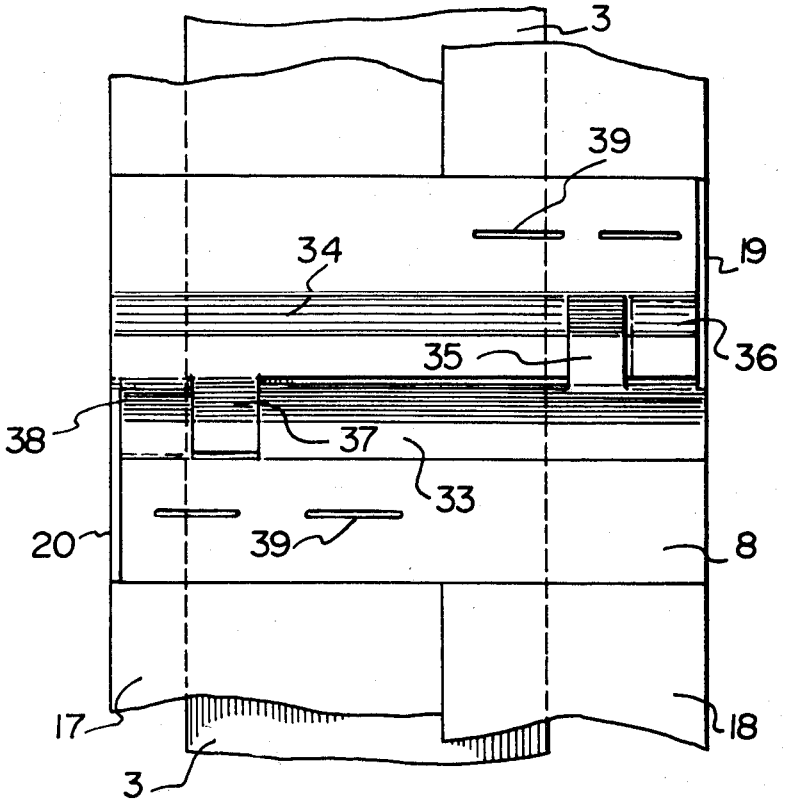
FIG. 11 illustrates a front elevation view of the slide guide assembly fastened to an adjustable width jamb.

FIG. 11 illustrates a front view of a wood hinge jamb assembly (or strike jamb assembly) including first hinge jamb piece 17, second hinge jamb piece 18, slide guide 8, and door stop 3, located behind jamb pieces 17 and 18. The upper and lower components of the slide guide 8 have at one opposing end thereof forwardly projecting clips 19 and 20. The construction of the slide guide 8 used for wooden jambs is identical to the construction of the steel slide guide 13 described above except for the presence of the clip 19. Each component of slide guide 8 can be formed from the same die. The upper component, at the left side opposite the clip 19, has extending downwardly therefrom V-profile tab 37, and adjacent V-profile underlying tab 38. The lower slide guide component has at the right side opposite clip 20, extending upwardly, V-profile tab 35, and adjacent V-profile underlying tab 36. The assembled slide guide 8 is secured to jamb pieces 17 and 18 respectively by means of construction staples 39, or similar suitable fastening devices.

Figure 12:
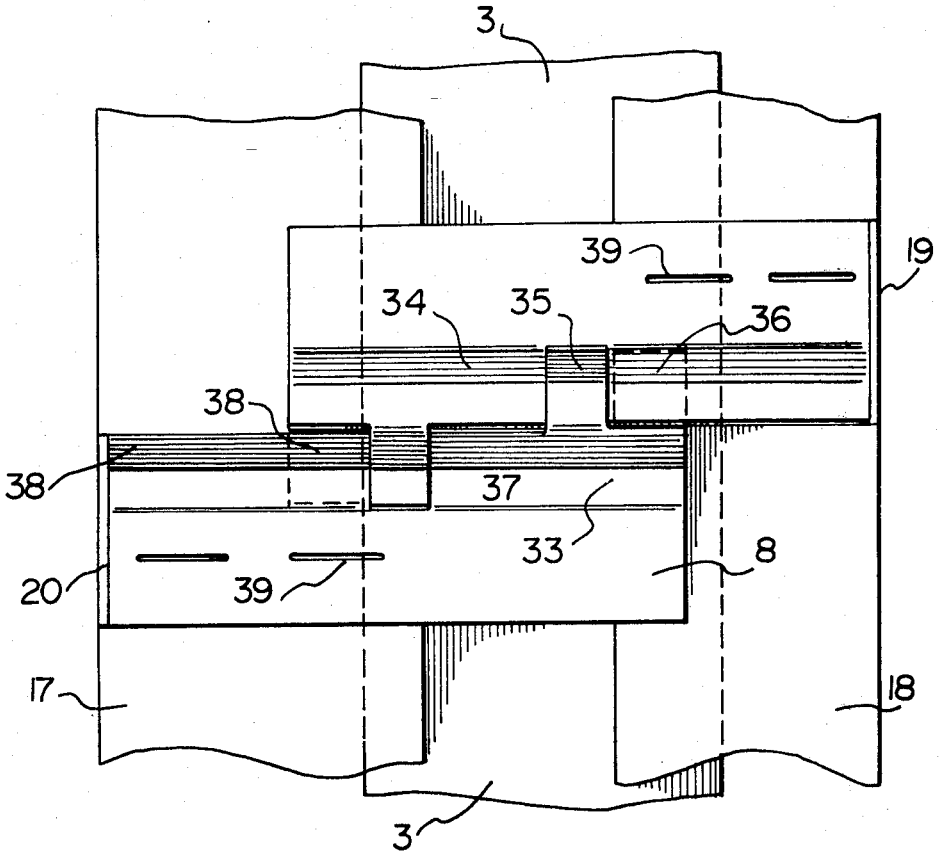
FIG. 12 illustrates a front elevation view of a steel slide guide secured to a jamb, the jamb being shown in extended orientation.

FIG. 12 illustrates the wood jamb assembly illustrated in FIG. 11, in a semi extended orientation. As seen in FIG. 12, first and second jamb pieces 17 and 18 are spread apart to expose a space between the two. However, from the opposite point of view, which is the side of the jamb that faces the door and is visible when the jamb is installed in a door opening, the space between pieces 17 and 18 is concealed by door stop 3. The lower component of the slide guide 8 is fastened by means of staples 39 only to jamb piece 17. Similarly, the upper component of the slide guide 8 is secured by staples 39 only to jamb piece 18. Accordingly, when jamb pieces 17 and 18 are spread apart, the two components of the slide guide 8 are moved to an extended position by means of the V-profile tabs 35 and 37, and the V-profile underlying tabs 36 and 38, travelling along the grooves 33 and 34 of the upper and lower components, thereby ensuring that jamb pieces 17 and 18 remain in proper planar orientation with one another as they are spread apart.

At the construction site, the carpenter assembling the door frame assembly in place spreads apart jamb pieces 17 and 18 as required so that the overall width of the jamb corresponds with the wall thickness of the door opening. When the wood jamb assembly is placed over the end of the wall where it meets the door opening in the wall, clips 19 and 20 are snugly secured on each side of the wall, and are fastened in place by means of suitable fastening devices such as nails or screws. Once in place, no further adjustment of the width of the jamb assembly need be made by the carpenter assembling and installing the door frame. The space between the two jamb pieces 17 and 18 is concealed from the door side point of view by the door stop 3. Door stop 3 is fully secured to either jamb unit 17 or jamb unit 18 (but not both because then it would be impossible to spread jamb units 17 and 18 apart) and thus provides a solid stop means for the door when it has been hung within the confines of the erected door frame assembly, as illustrated initially in FIG. 1. It will be recognized that the upper and lower components of the slide guide need not necessarily be secured to the jamb pieces 17 and 18 by means of staples 39. Staples 39 are convenient because they can be installed quickly and are relatively inexpensive. However, it will be understood that the slide guide components can be secured to the jamb units 17 and 18 by other suitable fastening means such as nails or screws. With the steel frame assembly and the steel slide guides 13, without the end clips 19 and 20, rivets, screws, or similar suitable fastening devices are utilized. Staples are not normally suitable for the steel frame assembly.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. A slide guide unit, suitable for use in constructing a jamb as part of a pre-fabricated door frame assembly, comprising:

(a) a generally broad body having therein along one side thereof a V-shaped groove extending substantially the length of the body;

(b) a first V-profile tab located at the same side of the body as the V-shaped groove, extending from the body in a direction away from the V-shaped groove, and in a plane generally aligned with the plane of the body and the V-shaped groove, the dimension of the V of the first V-shaped tab being generally commensurate with the dimension of the interior of the V-shaped groove; and (c) a second V-profile tab positioned on the same side of the body as the first V-profile tab, and in general alignment with the first V-profile tab extending in generally the same direction as the first V-profile tab, the dimension of the V of the second V-profile tab being generally commensurate with the dimension of the exterior of the V-shaped groove.

2. A slide guide according to claim 1 wherein the first and second V-profile tabs are adjacent one another on one side of the body, and the first V-profile tab is adapted to fit inside the V-shaped groove of a second slide guide unit, while the second V-profile tab is adapted to fit outside the V-shaped groove of the same second slide guide unit.

3. A slide guide according to claim 2 wherein a shoulder of the same general dimension as one side of the V-shaped groove is located on and extends from the side of the body opposite the V-shaped groove, and in the same general direction as the V-shaped groove.

4. A slide guide according to claim 1, 2 or 3 wherein a projection is located at one end of the body and extends generally at right angles with the general plane of the body.

5. A slide guide according to claim 1, 2 or 3 wherein a projection is located at one end of the body and extends generally at right angles with the general plane of the body while the base of the V-shaped groove extnds from the body in a direction generally opposite to the projection.

6. A slide guide according to claim 1, 2 or 3 wherein a projection is located at one end of the body and extends generally at right angles with the general plane of the body while the base of the V-shaped groove extends from the body in a direction generally opposite to the projection, and the first and second V-profile tabs are located adjacent one another on the same side of the body as the V-shaped groove at the end of the body opposite the projection.

7. A door jamb assembly comprising:

(a) a first elongated jamb piece;

(b) a second elongated jamb piece adjacent the first jamb piece (a) and aligned generally parallel therewith; and (c) an elongated door stop secured to and aligned parallel with jamb piece (a) and concealing the joint between jamb pieces (a) and (b); and (d) a slide guide unit according to claim 1 affixed to jamb piece (a) on the side of jamb piece (a) opposite door stop (c), and a second slide guide unit according to claim 1 affixed to jamb piece (b) on the side of jamb piece (b) opposite door stop (c); said second slide guide unit being inverted in relation to the first slide guide unit so that the first and second V-profile tab of the first slide guide unit cooperate with the V-shaped groove of the inverted second slide unit so that the two slide guide units can be moved in relation to one another by sliding the first and second V-profile tabs along the V-shaped groove.

8. A door jamb assembly according to claim 7 wherein the slide guide means (d) consists of two cooperating slide guide units constructed according to claim 2, so as to provide a means whereby jamb piece (a) of claim 7 can be spread apart from jamb piece (b) of claim 7.

9. A door jamb assembly according to claim 7 or 8 wherein clips are located at each end of the two components of the assembled slide guide and extend away from the slide guide and jamb pieces (a) and (b).

10. A door jamb assembly according to claim 7 or 8, wherein three separate assemblies are utilized to frame a door opening, one door jamb assembly comprising a vertical hinge jamb unit, a second door jamb assembly comprising a vertical strike jamb unit, and a third door jamb assembly acting as a horizontal header jamb unit, the header jamb unit adjoining and bridging the respective top ends of the hinge jamb assembly and the strike jamb assembly.

11. A door jamb assembly according to claim 7 or 8 wherein three separate assemblies are utilized to frame a door opening, one door jamb assembly comprising a vertical hinge jamb unit, a second door jamb assembly comprising a vertical strike jamb unit, and a third door jamb assembly acting as a horizontal header jamb unit, the header jamb unit being equipped with slide guide units at each end, the ends of which units have downwardly extending clips which cooperate with and secure the two ends of the header jamb unit to the upper ends of the hinge jamb unit and the strike jamb unit respectively.

* * * * *